US009431153B2

(12) United States Patent
Maioli et al.

(10) Patent No.: US 9,431,153 B2
(45) Date of Patent: Aug. 30, 2016

(54) ARMOURED CABLE FOR TRANSPORTING ALTERNATE CURRENT WITH REDUCED ARMOUR LOSS

(71) Applicant: PRYSMIAN S.P.A., Milan (IT)

(72) Inventors: Paolo Maioli, Milan (IT); Massimo Bechis, Milan (IT)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 14/402,978

(22) PCT Filed: Nov. 13, 2012

(86) PCT No.: PCT/EP2012/072440

§ 371 (c)(1),
(2) Date: Nov. 21, 2014

(87) PCT Pub. No.: WO2013/174455

PCT Pub. Date: Nov. 28, 2013

(65) Prior Publication Data

US 2015/0170795 A1 Jun. 18, 2015

(30) Foreign Application Priority Data

May 22, 2012 (WO) ..... PCT/EP2012/002184

(51) Int. Cl.
*H01B 7/00* (2006.01)
*H01B 7/26* (2006.01)
(Continued)

(52) U.S. Cl.
CPC ..... *H01B 7/26* (2013.01); *H01B 9/025* (2013.01); *H01B 7/14* (2013.01)

(58) Field of Classification Search
CPC ..... H01B 7/17; H01B 7/045; H01B 11/06; H01B 11/1025; H01B 11/203; H01B 11/02; H01B 12/02; H01B 12/06; H01B 7/10; H01B 7/20; H01B 7/22
See application file for complete search history.

(56) References Cited

U.S. PATENT DOCUMENTS

2002/0027014 A1* 3/2002 Mukoyama ..... H01B 12/02 174/125.1
2003/0024728 A1* 2/2003 Yamamoto ..... H01B 11/203 174/113 R (Continued)

FOREIGN PATENT DOCUMENTS

GB 360996 * 11/1931 ..... H01B 11/06
GB 685438 1/1953

(Continued)

OTHER PUBLICATIONS

International Search Report from the European Patent Office for International Application No. PCT/EP2012/072440, mailing date May 3, 2013.

(Continued)

*Primary Examiner* — William H Mayo, III
(74) *Attorney, Agent, or Firm* — Finnegan, Henderson, Farabow, Garrett & Dunner, L.L.P.

(57) ABSTRACT

An armored cable for transporting an alternate current at a maximum allowable working conductor temperature includes: at least two cores stranded together according to a core stranding lay and a core stranding pitch A; and an armor surrounding the at least two cores, the armor including one layer of a plurality of metal wires wound around the cores according to a helical armor winding lay and an armor winding pitch B, the helical armor winding lay having the same direction as the core stranding lay, the armor winding pitch B being from 0.4A to 2.5A and differing from the core stranding pitch A by at least 10%.

14 Claims, 6 Drawing Sheets

(51) Int. Cl.
*H01B 9/02* (2006.01)
*H01B 7/14* (2006.01)

(56) References Cited

U.S. PATENT DOCUMENTS

| | | | | |
|---|---|---|---|---|
| 2004/0200637 | A1* | 10/2004 | Yumura | H01B 12/06 174/125.1 |
| 2006/0048966 | A1* | 3/2006 | Takahashi | H01B 11/1025 174/108 |
| 2011/0139485 | A1* | 6/2011 | Matsuda | H01B 11/002 174/102 R |
| 2011/0247856 | A1* | 10/2011 | Matsuda | H01B 11/203 174/108 |
| 2014/0166335 | A1* | 6/2014 | Kagoura | H01B 7/045 174/107 |

FOREIGN PATENT DOCUMENTS

| | | | | |
|---|---|---|---|---|
| GB | 1051860 | * | 12/1966 | H01B 11/06 |
| WO | WO 2013/174455 A1 | | 11/2012 | |

OTHER PUBLICATIONS

Written Opinion of the International Searching Authority from the European Patent Office for International Application No. PCT/EP2012/072440, mailing date May 3, 2013.

"Electric Cables—Calculation of the Current Rating—Part 1-1: Current Rating Equations (100 % Load Factor) and Calculation of Losses—General", International Electrotechnical Commission, International Standard IEC 60287-1-1 (Second Edition 006-12), pp. 1-65, (2006).

Bremnes et al.; "Power Loss and Inductance of Steel Armoured Multi-Core Cables: Comparison of IEC Values With "2,5D" FEA Results and Measurements", Cigrè, B1_116_2010, pp. 1-10, (2010).

Gaia Dell'Anna et al.; "HV Submarine Cables for Renewable Offshore Energy", Cigrè, 241, Bologna 2011, 7 pages, (2011).

"Electric Cables—Calculation of the current rating; Part 1-1: Current rating equations (100% load factor) and calculation of losses—General"; International Standard CEI IEC 60287-1-1, Second Edition pp. 1-65, (2006).

M. Jeroense et al.; "HV AC Power Transmissions to the Gjøa Platform", Cigrè Paris Session 2010, pp. 1-9 (2010).

Zaccone; "Mechanical Aspects of Submarine Cable Armour", Spring Meeting 2012 of the ICC, subgroup C11D, ICC Submarine Cables, 16 pages (2012).

Worzyk; "Submarine Power Cables", Design, Installation, Repair, Environmental Aspects, Springer-Verlag Berlin Heidelberg, 2 title pages and pp. 33-35, (2009).

PCT Communication in Cases for Which on Other Form is Applicable, Third Party Observation, issued May 2, 2014, by the International Bureau of WIPO in International Application No. PCT/EP2012/072440.

* cited by examiner

ARMOURED CABLE FOR TRANSPORTING ALTERNATE CURRENT WITH REDUCED ARMOUR LOSS

CROSS REFERENCE TO RELATED APPLICATIONS

This application is a national phase application based on PCT/EP2012/072440, filed Nov. 13, 2012, and claims the priority of International Patent Application No. PCT/EP2012/002184, filed May 22, 2012, the content of each application being incorporated herein by reference.

BACKGROUND OF THE INVENTION

1. Field of the Invention

The present invention relates to a method for transporting alternate current in an armoured cable.

2. Description of the Related Art

An armoured cable is generally employed in application where mechanical stresses are envisaged. In an armoured cable, the cable core or cores (typically three stranded cores in the latter case) are surrounded by at least one metal layer in form of wires for strengthening the cable structure while maintaining a suitable flexibility.

When alternate current (AC) is transported into a cable, the temperature of electric conductors within, the cable rises due to resistive losses, a phenomenon referred to as Joule effect.

The transported current and the electric conductors are typically sized in order to guarantee that the maximum temperature in electric conductors is maintained below a prefixed threshold (e.g., below 90° C.) that guarantees the integrity of the cable.

The international standard IEC 60257-1-1 (second edition 200-12) provides methods for calculating permissible current rating of cables from details of permissible temperature rise, conductor resistance, losses and thermal resistivities. In particular, the calculation of the current rating in electric cables is applicable to the conditions of the steady-state operation at all alternating voltages. The term "steady state" is intended to mean a continuous constant current (100% load factor) just sufficient to produce asymptotically the maximum conductor temperature, the surrounding ambient conditions being assumed constant. Formulae for the calculation of losses are also given.

In IEC 60287-1-1, the permissible current rating of an AC cable is derived from the expression for the permissible conductor temperature rise $\Delta\theta$ above ambient temperature Ta, wherein $\Delta\theta = T - Ta$, T being the conductor temperature when a current I is flowing into the conductor and Ta being the temperature of the surrounding medium under normal conditions, at a situation in which cables are installed, or are to be installed, including the effect of any local source of heat, but not the increase of temperature in the immediate neighbourhood of the cables to heat arising therefrom. For example, the conductor temperature T should be kept lower than about 90° C.

For example, according to IEC 60287-1-1, in case of buried AC cables where drying out of the soil does not occur or AC cables in air, the permissible current rating can be derived from the expression for the temperature rise above ambient temperature $$I = \left[\frac{\Delta\theta - W_d \cdot [0.5 \cdot T_1 + n \cdot (T_2 + T_3 + T_4)]}{R \cdot T_1 + n \cdot R \cdot (1 + \lambda_1) \cdot T_2 + n \cdot R \cdot (1 + \lambda_1 + \lambda_2) \cdot (T_3 + T_4)}\right]^{0.5} \quad (1)$$

where

I is the current flowing in one conductor (Ampere)

$\Delta\theta$ is the conductor temperature rise above the ambient temperature (Kelvin)

R is the alternating current resistance per unit length of the conductor at maximum operating temperature (Ω/m);

$W_d$ is the dielectric loss per unit length for the insulation surrounding the conductor (W/m);

$T_1$ is the thermal resistance per unit length between one conductor and the sheath (K·m/W);

$T_2$ is the thermal resistance per unit length of the bedding between sheath and armour (K·m/W);

$T_3$ is the thermal resistance per unit length of the external serving of the cable (K·m/W);

$T_4$ is the thermal resistance per unit length between the cable surface and the surrounding medium (K·m/W);

n is the number of load-carrying conductors in the cable (conductors of equal size and carrying the same load);

$\lambda_1$ is the ratio of losses in the metal sheath to total losses in all conductors in that cable;

$\lambda_2$ is the ratio of losses in the armoring to total losses in all conductors in the cable.

In case of three-core cables and steel wire armour, the ratio $\lambda_2$ is given, in IEC 60287-1-1, by the following formula:

$$\lambda_2 = 1.23\frac{R_A}{R}\left(\frac{2c}{d_A}\right)^2 \frac{1}{\left(\frac{2.77 R_A 10^6}{\omega}\right)^2 + 1} \quad (2)$$

where $R_A$ is the AC resistance of armour at maximum armour temperature (Ω/m);

R is the alternating current resistance per unit length of conductor at maximum operating temperature (Ω/m);

$d_A$ is the mean diameter of armour (mm);

c is the distance between the axis of a conductor and the cable centre (mm);

ω is the angular frequency of the current in the conductors.

The Applicant observes that, in general, the reduction of losses means reduction of the cross-section of the conductor/s and/or an increase of the permissible current rating.

In case of an armoured AC cable, the contribution of the armour losses to the overall cable losses has been investigated.

J. J. Bremnes et al ("Power loss and inductance of steel armoured multi-core cables: comparison of IEC values with "2.5D" FEA results and measurements", Cigré, Paris, B1-116-2010) analyze armour loss in a three-core cable. They state that, for balanced three-phase currents, the collective armour will not allow any induced current flow in the armour wires due to cancellation by stranding/twisting. Any exception to this will require that the armour wires have exactly the same pitch as the cores, that the cable is very short, or that all armour wires are continuously touching both neighbouring wires. The authors state that this is in sharp contrast to the formulae for multi-core armour loss given in IEC 60287-1-1, in which the armour resistance $R_A$ is an important parameter. The authors state that, typically, for a three-core submarine cable, the IEC formula will assign 20-30% power loss to a collective steel armour, while their 2.5D finite element models and full scale measurements both predict insignificant power loss in the armour. G. Dell'Anna et al, ("HV submarine cables for renewable offshore energy", Cigré, Bologna, 0241-2011) state that AC magnetic field induces losses in the armour and that hysteresis and eddy current are responsible for the losses generated into the armour. The authors show experimental results obtained by measuring the losses on a 12.3 m long cable, with a copper conductor of 800 $mm^2$, and an outer diameter of 205 mm. The measurements were made for a current ranging from 20 A to 1600 A. FIG. 4 shows the measured values of the phase resistance, in two conditions with lead sheaths short circuited and armour present or completely removed. The phase resistance (that is the cable losses) is constant with the current in absence of armour, while it increases with current in presence of the armour. The authors state that the numerical value of the losses is important, especially for large conductor cables, but it is not as high as reported in IBC 60287-1-1 formulae.

SUMMARY OF THE INVENTION

The Applicant notes that Bremnes et al. state that power losses in the armour are insignificant. However, they use 2.5D finite element models and perform the loss measures with 8.5 km and 12 km long cables with a very low test current of 51 A and conductors of 500 and 300 $mm^2$. The Applicant observes that a test current of 51 A cannot be significant for said conductor size transporting, typically, standard current values higher than 500A.

On the other hand, Dell'Anna et al. state that the losses generated into the armour are due to hysteresis and eddy current, they increase with current in presence of the armour and their numerical value is important, especially for large conductor cables, but not as high as reported in IEC 60287-1-1 formula.

In view of the contradictory teaching in the prior art documents, the Applicant further investigated the armour losses in an AC electric cable comprising at least two cores stranded together according to a core stranding pitch A, each core comprising an electric conductor, and an armour comprising one layer of wires helically wound around the cable according to an armour winding pitch B.

During its investigation, the Applicant observed that the armour losses highly change depending on the fact that the armour winding pitch B is unilay or contralay to the core stranding pitch A.

In particular, the Applicant observed that the armour losses are highly reduced when the armour winding pitch B is unilay to the core stranding pitch A, compared with the situation wherein the the armour winding pitch B is instead contralay to the core stranding pitch A, and when pitch B has a predetermined value with respect to pitch A.

The Applicant thus found that, by using an armoured AC cable comprising an armour layer with an armour winding pitch B which is unilay to the core stranding pitch A and has a predetermined value with respect to pitch A, the armour losses are reduced. In this way it is possible to comply with IEC 60287-1-1 requirements for permissible current rating by transmitting into the cable conductor an increased current value and/or by using cable conductors with a reduced value of the cross section area S (the AC resistance per unit length R in the above formula (1) being proportional to $\rho/S$, wherein $\rho$ is the conductor material electrical resistivity).

In a first aspect the present invention thus relates to a method for transporting an alternate current I at a maximum allowable working conductor temperature T comprising:

providing a power cable comprising at least two cores stranded together according to a core stranding lay and a core stranding pitch A, each core comprising an electric conductor having a cross section area S and conductor losses when the current I is transported;

providing an armour surrounding the at least two cores, said armour comprising one layer of a plurality of metal wires wound around the cores according to a helical, armour winding lay and an armour winding pitch B, said armour having armour losses when the current I is transported; said conductor losses and armour losses contributing to overall cable losses determining the maximum allowable working conductor temperature T;

causing the alternate current I to flow into the cable;

wherein the helical armour winding lay has the same direction as the core stranding lay, the armour winding pitch is of from 0.4A to 2.5A and differs from A by at least 10%, and the cross section area S is such to cause the cable to operate at the maximum allowable conductor temperature T while transporting the alternate current I with armour losses equal to or lower than 30% of the overall cable losses.

In the present description and claims, the term "core" is used to indicate an electric conductor surrounded by at least one insulating layer and, optionally, at least one semiconducting layer. Optionally, said core further comprises a metal screen.

In the present description and claims, the term "unilay" is used to indicate that, the winding of the wires of a cable layer (in the case, the armour) around the cable and the stranding of the cores have a same direction, with a same or different pitch.

In the present description and claims, the term "contralay" is used to indicate that the winding of the wires of a cable layer (in the case, the armour) around the cable and the stranding of the cores have an opposite direction, with a same or different pitch.

In the present description and claims, the term "maximum allowable working conductor temperature" is used to indicate the highest temperature a conductor is allowed to reach in operation in a steady state condition, in order to guarantee integrity of the cable. Such temperature substantially depends on the overall cable losses, including conductor losses due to the Joule effect and dissipative phenomena.

The armour losses are another significant component of the overall cable losses.

In the present description and claims, the term "permissible current rating" is used to indicate the maximum current that can be transported in an electric conductor in order to guarantee that the electric conductor temperature does not exceed the maximum allowable working conductor temperature in steady state condition. Steady state is reached when the rate of heat generation in the cable is equal to the rate of heat dissipation from the surface of the cable.

In the present description and claims the term "ferromagnetic" indicates a material, e.g. steel, that below a given temperature can possess magnetization in the absence of an external magnetic field.

In the present description and claims, the term "crossing pitch C" is used to indicate the length of cable taken by the wires of the armour to make a single complete turn around the cable cores. The crossing pitch C is given by the following relationship:

$$C = \left| \frac{1}{\frac{1}{A} - \frac{1}{B}} \right|$$

wherein A is the core stranding pitch and B is the armour winding pitch. A is positive when the cores stranded together turn right (right screw) and B is positive when the armour wires wound around the cable turn right (right screw). The value of C is always positive. When the values of A and B are very similar (both in modulus and sign) the value of C becomes very large.

According to the invention, the performances of the power cable are advantageously improved in terms of increased alternate current and/or reduced electric conductor cross section area S with respect to that provided for in permissible current rating requirements of IEC Standard 60207-1-1.

The alternate current I caused to flow into the cable and the cross section area S advantageously comply with permissible current rating requirements according to IEC Standard 60287-1-1, with armour losses equal to or lower than 30% of the overall cable losses.

Preferably, the armour losses are equal to or lower than 20% of the overall cable losses. Preferably the armour losses are equal to or lower than 10% of the overall cable losses. By a proper selection of the pitch parameters, the armour losses can amount down to 3% of the overall cable losses.

Preferably, pitch $B \geq 0.5A$. More preferably, pitch $B \geq 0.6A$. Preferably, pitch $B \leq 2A$. More preferably, pitch $B \leq 1.8A$.

Advantageously, the core stranding pitch A, in modulus, is of from 1000 to 3000 mm. Preferably, the core stranding pitch A, in modulus, is of from 1500 mm. Preferably, the core stranding pitch A, in modulus, is not higher than 2600 mm.

According to the present invention, preferably crossing pitch $C \geq A$. More preferably, $C \geq 5A$. Even more preferably, $C \geq 10A$. Suitably, C can be up to 12A.

Suitably, the armour surrounds the at least two cores together, as a whole.

In an embodiment, the at least two cores are helically stranded together.

In an embodiment, the armour further comprises a first outer layer of a plurality of metal wires, surrounding said layer of a plurality of metal wires. The metal wires of said first outer layer are suitably wound around the cores according to a first outer layer winding lay and a first outer layer winding pitch B'. Preferably, the first outer layer winding lay is helicoidal.

Preferably, the first outer layer winding lay has an opposite direction with respect to the core stranding lay (that is, the first outer layer winding lay is contralay with respect to the core stranding lay and with respect to the armour winding lay). This contralay configuration of the first outer layer is advantageous in terms of mechanical performances of the cable.

Preferably, the first outer layer winding pitch B' is higher, in absolute value, of the armour winding pitch B. More preferably, the first outer layer winding pitch B' is higher, in absolute value, of B by at least 10% of B.

In the embodiment wherein the armour also comprises the first outer layer, the cross section area S of the electric conductor is such as to cause the cable to operate at the maximum allowable conductor temperature T while transporting the alternate current I with armour losses equal to or lower than 30% of the overall cable losses, the armour losses comprising both the losses in said layer and in said first outer layer.

In an embodiment, the armour further comprises a second outer layer of a plurality of metal wires, surrounding said first outer layer. The metal wires of said second outer layer are suitably wound around the cores according to a second outer layer winding lay and a second outer layer winding pitch B". Preferably, the second outer layer winding lay is helicoidal. Preferably, the second outer layer winding lay has the same direction as the core stranding lay (that is, the second outer layer winding lay is unilay with respect to the core stranding lay and with respect to the armour winding lay). Preferably, the second outer layer winding pitch B" is different from the armour winding pitch B. Preferably the modulus $|B''-A|$ is higher than $|B-A|$.

In the embodiment wherein the armour also comprises the second outer layer of a plurality of metal wires, the cross section area S of the electric conductor is such to cause the cable to operate at the maximum allowable conductor temperature T while transporting the alternate current I with armour losses equal to or lower than 30% of the overall cable losses, the armour losses comprising the losses in said layer, in said first outer layer and in said second outer layer.

In an embodiment, the wires of the armour are made of ferromagnetic material. For example, they are made of construction steel, ferritic stainless steel or carbon steel.

In another embodiment, the wires of the armour can be mixed ferromagnetic and non-ferromagnetic. For example, in the layer of wires, ferromagnetic wires can alternate with non-ferromagnetic wires and/or the wires can have a ferromagnetic core surrounded by a non-ferromagnetic material (e.g. plastic or stainless steel).

Advantageously, the armour wires have a cross-section diameter of from 2 to 10 mm. Preferably, the diameter is of from 4 mm. Preferably, the diameter is not higher than 7 mm. The armour wires can have polygonal or, preferably, round cross-section.

Preferably, the at least two cores are single phases core. Advantageously, the at least two cores are multi-phase cores.

In a preferred embodiment, the cable comprises three cores. In AC systems, the cable advantageously is a three-phase cable. The three-phase cable advantageously comprises three single phase cores.

The AC cable can be a low, medium or high voltage cable (LV, MV, HV, respectively). The term low voltage is used to indicate voltages lower than 1 kV. The term medium voltage is used to indicate voltages of from 1 to 35 kV. The term high voltage is used to indicate voltages higher than 35 kV.

The AC cable may be terrestrial or submarine. The terrestrial cable can be at least in part buried or positioned in tunnels.

BRIEF DESCRIPTION OF THE DRAWINGS

The features and advantages of the present invention will be made apparent by the following detailed description of some exemplary embodiments thereof, provided merely by way of non-limiting examples, description that will be conducted by making reference to the attached drawings, wherein.

DETAILED DESCRIPTION OF THE INVENTION

Figure 1:
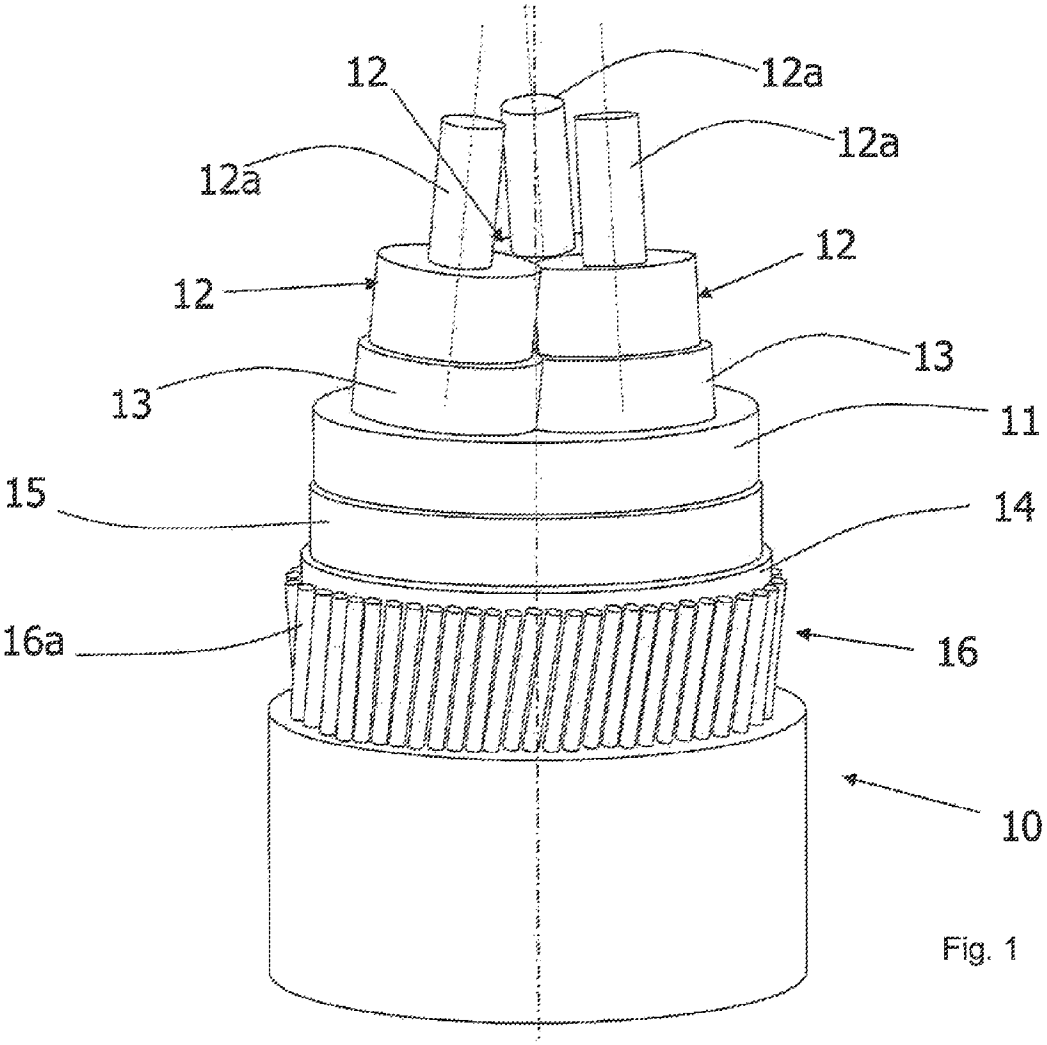
FIG. 1 schematically shows an exemplary power cable that can be used for implementing the method of the invention.

FIG. 1 schematically shows an exemplarily AC three-core cable 10 for submarine application comprising three cores 12. Each core comprises a metal conductor 12*a* typically made of copper, aluminium or both, in form of a rod or of stranded wires. The conductor 12*a* is sequentially surrounded by an inner semiconducting layer and insulating layer and an outer semiconducting layer, said three layers (not shown) being made of polymeric material (for example, polyethylene), wrapped paper or paper/polypropylene laminate. In the case of the semiconducting layer/s, the material thereof is charged with conductive filler such as carbon black.

Figure 7:
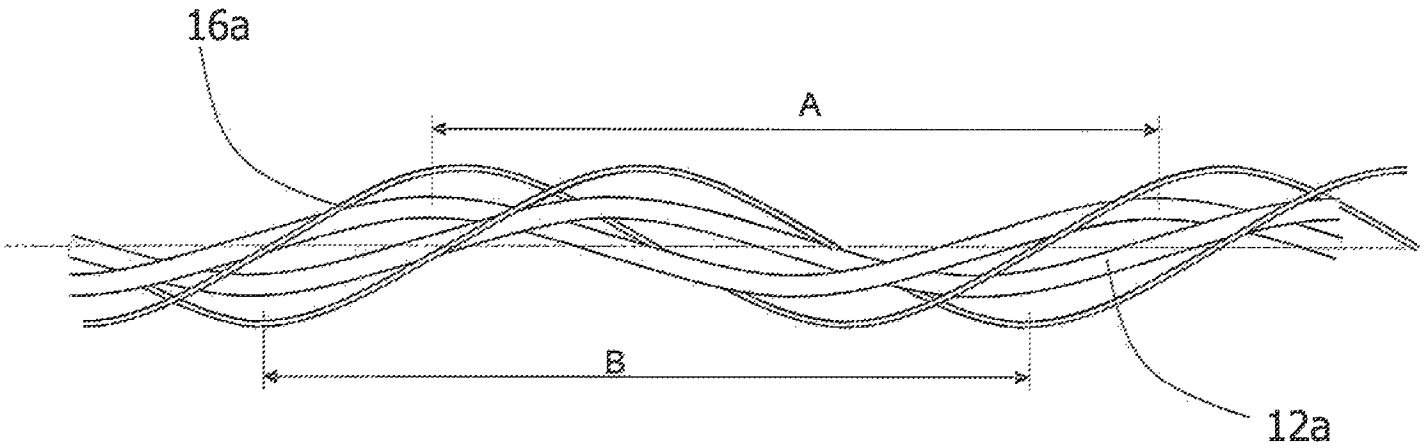
FIG. 7 schematically illustrates stranded cores and wound armour wires, respectively with core stranding pitch A and armour winding pitch B, of a cable suitable for the invention.

The three cores 12 are helically stranded together according to a core stranding pitch A. The three cores 12 are each enveloped by a metal sheath 13 (for example, made of lead) and embedded in a polymeric filler 11 surrounded, in turn, by a tape 15 and by a cushioning layer 14. Around the cushioning layer 14 an armour 16 comprising a single layer of wires 16*a* is provided. The wires 16*a* are helically wound around the cable 10 according to an armour winding pitch B. According to the invention, the armour winding pitch B is unilay to the core stranding pitch A, as shown in FIG. 7.

The wires 16*a* are metallic, preferably are made of a ferromagnetic material such as carbon steel, construction steel, ferritic stainless steel.

The conductor 12*a* has a cross section area S, wherein $S=\pi(d/2)^2$, d being the conductor diameter.

During development activities performed by the Applicant in order to investigate the armour losses in an AC electric cable, the Applicant analyzed a first AC cable having three cores stranded together according to a core stranding pitch A of 2570 mm; a single layer of eighty-eight (88) wires wound around the cable according to an armour winding pitch B contralay to the core stranding pitch A, B being −1890 mm, and crossing pitch C equal to about 1089 mm; a wire diameter d of 6 mm; a cross section area S of 800 $mm^2$.

The Applicant analyzed also a second AC cable having three cores stranded together according to a core pitch A of 1442 mm; a single layer of sixty-one (61) wires wound around the cable according to an armour winding pitch B unilay to the core pitch A, B being 1117 mm, and crossing pitch C equal to about 4956 mm; a wire diameter d of 6 mm; a cross section area S of 500 $mm^2$.

The Applicant experimentally measured the phase resistance (Ohm/m) of the first and second cable with and without armour wires, for an AC current in each conductor ranging from 20 A to 1600 A. The phase resistance was obtained from measured cable losses dividing by 3 (number of conductors) and by the square of the current I circulating into the conductors. The phase resistance was measured for the two cables with a progressive reduction of the number of wires, starting with the complete armouring with 88/61 wires, and than progressively removing the wires equally distributed around the cable.

Figure 2:
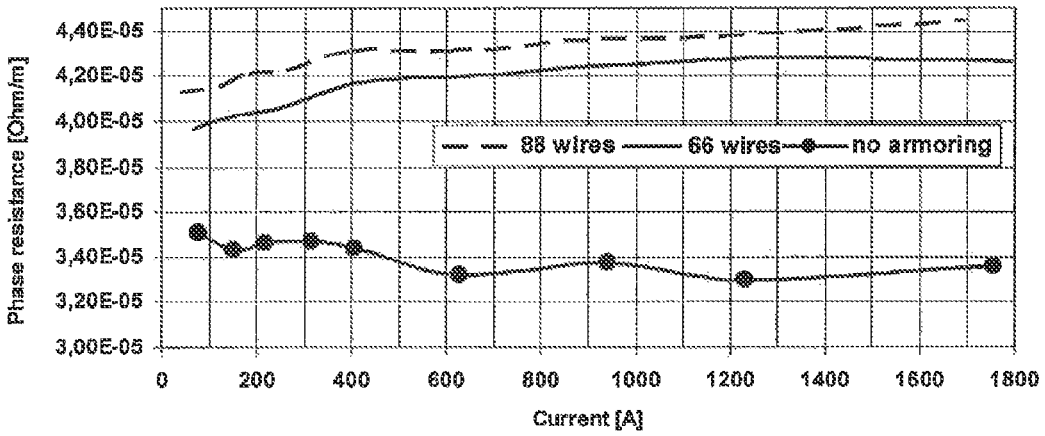
FIG. 2 shows the phase resistance measured in a three-core cable versus the AC current flowing therein, said cable having a varying number of armour wires.

FIG. 2 shows the phase resistance measured for the first cable (contralay cable). In particular, the measures have been made with a progressive reduction of the number of the wires, starting with the complete armour with 88 wires, and than removing 1 wire every 8 wires equally distributed around the cable. Measures with complete armour (88 wires), 66 armour wires and with armour wires completely removed are reported in FIG. 2.

Figure 3:
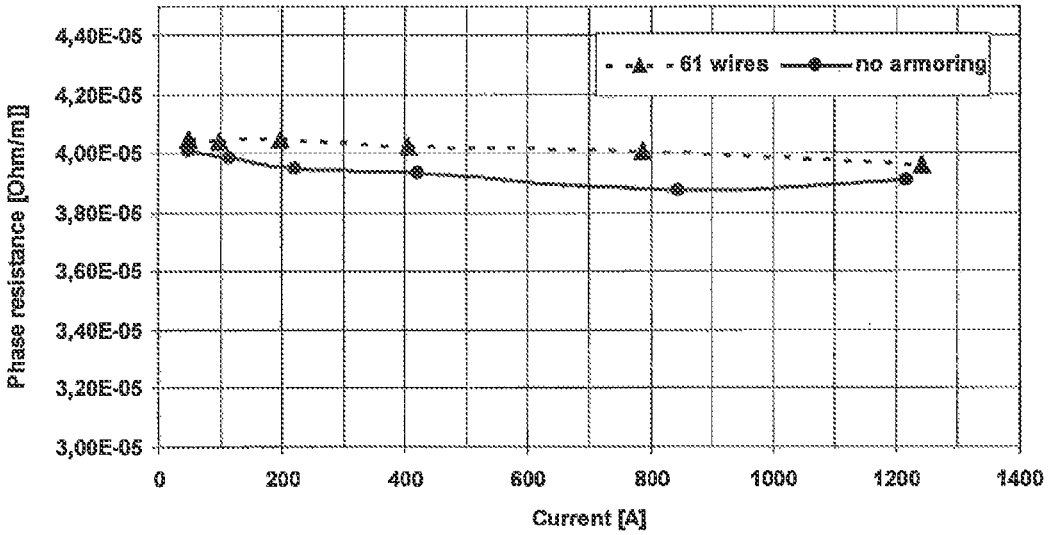
FIG. 3 shows the phase resistance measured in a three-core cable versus the AC current flowing therein, with or without armour wires.

FIG. 3 shows the phase resistance measured for the second cable (unilay cable). The phase resistance values obtained for this armoured cable were well lower than that obtained for the first armoured cable and the variation of the phase resistance in the absence of armour wires was not so remarkable for this second cable. For this reason, only the first and the last measure (with complete 61-wire armour and without armour) are shown in FIG. 3, even if the measures have been made with a progressive reduction of the number of the wires also for this second cable.

In FIGS. 2 and 3, "E" symbol means "elevated" and "E-05" means "1·10-5".

By comparing the results of FIGS. 2 and 3, the Applicant further observed that the value of the difference of the phase resistance measured for the second cable with complete armour and without armour is of the order of 1·10-6 Ohm/m, that is around 10 times less than that measured for the first cable with complete armour, and anyway remarkably lower than that of the first cable with a similar number of armour wires (61 in the second cable versus 66 in the first armoured cable).

By analysing the results of FIG. 2, the Applicant further observed that the phase resistance decreases by reducing the number of wires.

The Applicant noted that this last observation clashes with the formula (see formula 2 disclosed above) given by the IEC 60287-1-1 for $\lambda_2$ (i.e., the ratio of losses in the armour to total losses in all conductors). In fact, according to IEC 60287-1-1, the layer of armour wires is cumulatively modelled as a solid tube having resistance $R_A$ (in AC regime) given by $(\rho \cdot L)/(S \cdot N_{wires})$, wherein ρ is the electric resistivity of the wire material, S is the cross section area of the wire, L is the wire length and $N_{wires}$ is the total number of wires in the armour. As according to IEC 60287-1-1 the armour resistance $R_A$ increases with a decreasing number of wires, according to IEC 60287-1-1, $\lambda_2$ (and thus the above mentioned phase resistance) should increase (and not decrease as shown in FIG. 2) with a decreasing number of wires.

By observing that the phase resistance depends on the current I circulating into the conductors and that it is quite low for low current values, the Applicant further found that the results mentioned above, obtained by J. J. Bremnes et al. with 8.5 km and 12 km long cables and a test current of 51 A, cannot be applied to MV/HV cables transporting standard current values, typically higher than 500 A.

Indeed, the Applicant believes that eddy currents and hysteresis are responsible for the losses generated into the armour. However, low AC current values (e.g. test current of 51 A used by J. J. Bremnes et al.) do not trigger hysteresis and induce very low eddy currents.

Furthermore, about the result that the value of the difference of the phase resistance measured for the second cable with complete armour (61 wires) and without armour is around 10 times less than that measured for the first cable (with complete armour of 88 wires), the Applicant observed that such a difference could not be (at least solely) ascribed to the fact that the second cable has a smaller cross section and a smaller number of wires in the armour.

The Applicant thus further investigated the armour losses in an AC cable by computing the armour losses percentage as a function of the armour winding pitch B.

In particular, the armour losses were computed by assuming them as inversely proportional to crossing pitch C. The following conditions were considered: an AC three-core cable with the cores stranded together according to a core stranding pitch A, with A=2500 mm; only one armour wire, wound around the cable according to a variable armour winding pitch B; an hypothesis that the losses in the armour wire are inversely proportional to the crossing pitch C; a current of 800 A into the conductors; a conductor cross section area S of 800 $mm^2$.

Figure 4:
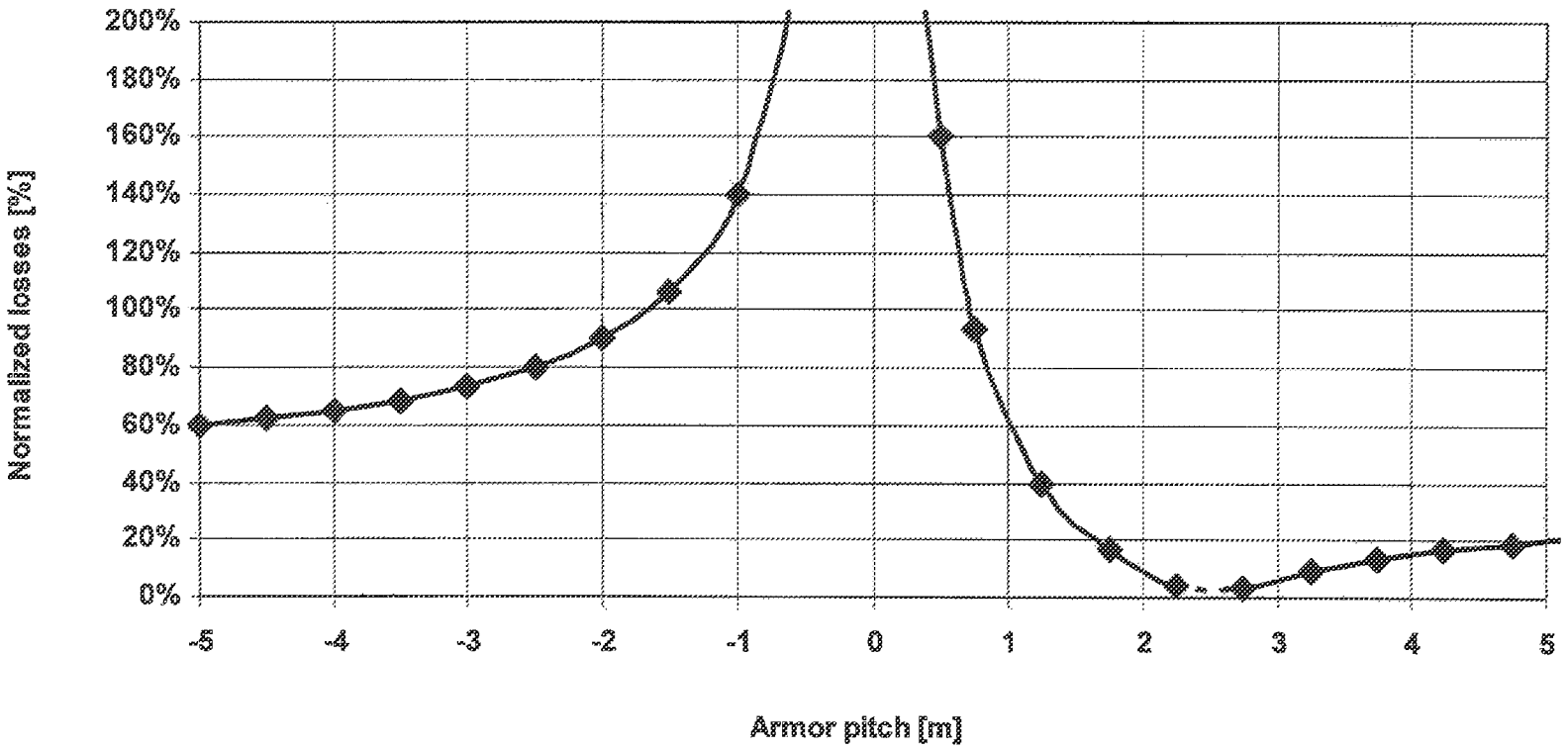
FIG. 4 shows the armour losses computed for a tree-core cable versus the armour winding pitch B, by considering the armour losses inversely proportional to crossing pitch C.

FIG. 4 shows the results of the computing the percentage of armour losses as a function of the armour winding pitch B according to the just mentioned conditions. The computation considered losses at 100% those empirically measured with the first cable of FIG. 2. Negative value of the armour winding pitch means contralay winding directions of the armouring wires with respect to the cores; positive value of the armour winding pitch means unilay winding directions of the armouring wires with respect to the cores.

As visible in FIG. 4, on the hypothesis made that the value of the armour losses in the armour wire is inversely proportional to the crossing pitch C, the armour losses are high when armour winding pitch B—either unilay or contralay with respect to core stranding pitch A—is very short (and, as a consequence, crossing pitch C is about ⅓ of core stranding pitch A).

An increase of armour winding pitch B—either unilay or contralay with respect to core stranding pitch A—brings to reduction of the armouring losses, the trend of such reduction being striking in the case armour winding pitch B is unilay with respect to core stranding pitch A. For example, a unilay armour winding pitch B of about 1500 mm results in armouring loss percentage of about 25% (−75% with respect to the empirical value obtained for the first cable of FIG. 2), whereas a contralay armour winding pitch B of about 1500 mm (about −1500 mm) results in armouring loss percentage of about 105% (+5% with respect to said empirical value).

Armouring losses have a minimum when core stranding pitch A and armour winding pitch B are substantially equal (unilay and with about the same pitch).

In view of the just mentioned results, the Applicant further investigated the armour losses for an AC cable in the same conditions as that of FIG. 4, but using a 3D FEM (Finite Element Method) computation for verifying the hypothesis made in the computation of FIG. 4.

Figure 5:
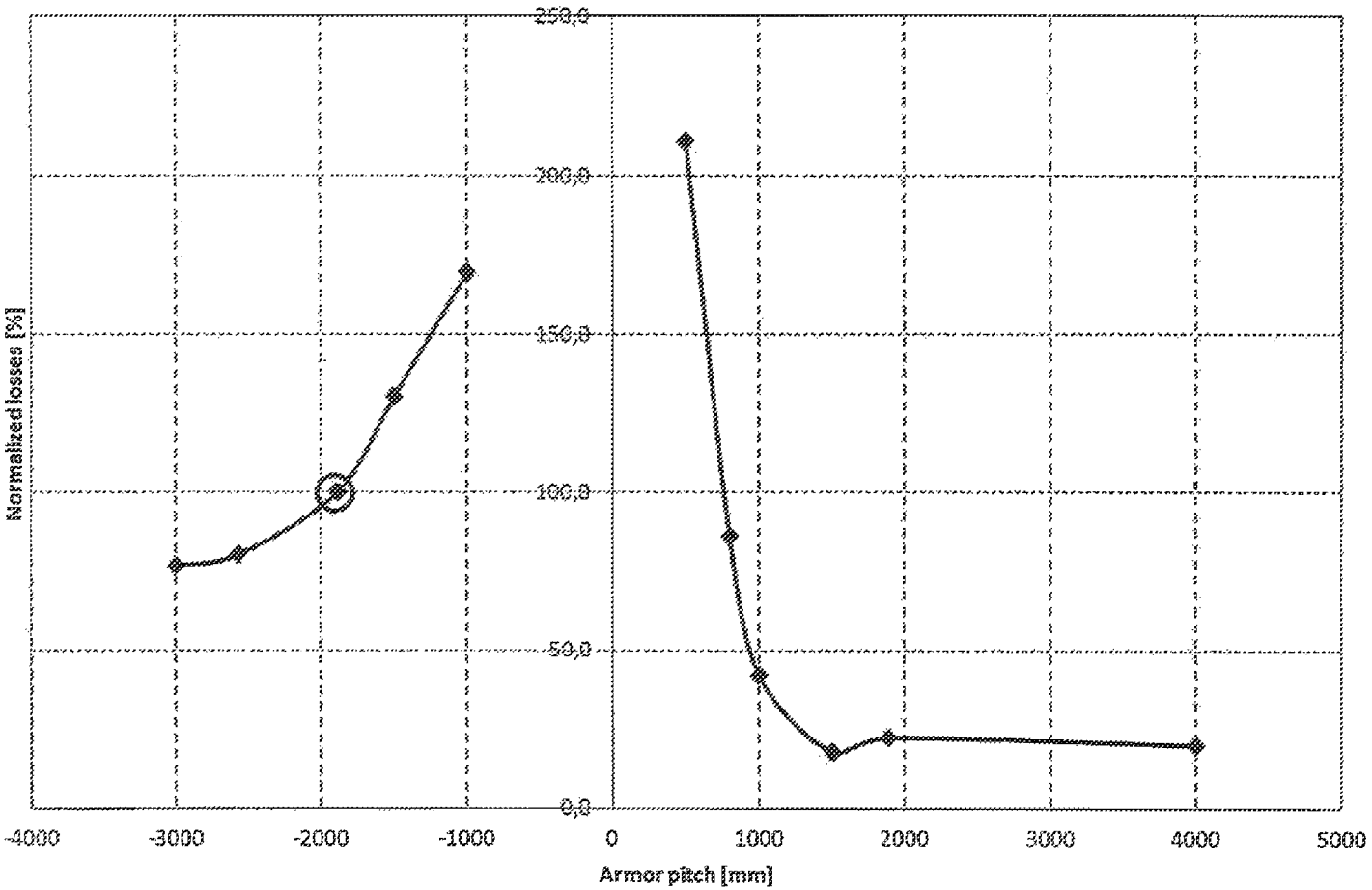
FIG. 5 shows the armour losses versus the armour winding pitch B computed for the same cable of FIG. 4 by using a 3D FEM computation.

Like in the case of the computation of FIG. 4, the FEM computation considered losses at 100% those empirically measured with the first cable of FIG. 2 (value marked with a circle in FIG. 5).

The results of the FEM computations are reported in FIG. 5 wherein the armour loss percentages as a function of the armour winding pitch B are shown. Also in this case the armour losses have a minimum when core stranding pitch A and armour winding pitch B are equal (unilay cable with cores and armour wire with the same pitch) while they are very high when B is close to zero (positive or negative). In addition, the armour loss percentages can be as low as 25% or less when B is positive (unilay cable) whereas such percentages are at least about 75% when B is negative (contralay cable).

The pattern of the armour losses in FIG. 5 is very similar to that shown in FIG. 4. The FEM computation performed by the Applicant thus confirmed that the hypothesis made in the computations of FIG. 4 (that the value of the armour losses in the armour wire is inversely proportional to the crossing pitch C) is correct.

The Applicant thus found that the armour losses highly change depending on the fact that the armour winding pitch B is unilay or contralay to the core stranding pitch A. In particular, the armour losses are highly reduced when the armour winding pitch B is unilay to the core stranding pitch A, compared with the situation wherein the armour winding pitch B is contralay to the core stranding pitch A.

Advantageously, the armour winding pitch B is higher than 0.4A. Preferably, B≥0.5A. More preferably, B≥0.6A. Advantageously, the armour winding pitch B is smaller than 2.5A. More preferably, the armour winding pitch B is smaller than 2A. Even more preferably, the armour winding pitch B is smaller than 1.8A.

Advantageously, the armour winding pitch B is different from the core stranding pitch A (B≠A). Such a difference is at least equal to 10% of pitch A. Though seemingly favourable in term of armouring loss reduction, the configuration with B=A would be disadvantageous in terms of mechanical strength.

Advantageously, the core stranding pitch A, in modulus, is of from 1000 to 3000 mm. More advantageously, the core stranding pitch A, in modulus, is of from 1500 to 2600 mm. Low values of A are economically disadvantageous as higher conductor length is necessary for a given cable length. On the other side, high values of A are disadvantageous in term of cable flexibility.

Advantageously, crossing pitch C is preferably higher than the core stranding pitch A, in modulus. More preferably, C≥3A, in modulus. Even more preferably, C≥10A, in modulus.

Without the aim of being bound to any theory, the Applicant believes that the present finding (that the armour losses are highly reduced when B is unilay to A) is due to the fact that when A and B are of the same sign (same direction) and, in particular, when A and B are equal or very similar to each other, the cores and the armour wires are parallel or nearly parallel to each other. This means that the magnetic field generated by the AC current transported by the conductors in the cores is perpendicular or nearly perpendicular to the armour wires. This cause the eddy currents induced into the armour wires to be parallel or nearly parallel to the armour wires longitudinal axis.

On the other hand, when A and B are of opposite sign (contralay), the cores and the armour wires are perpendicular or nearly perpendicular to each other. This means that the magnetic field generated by the AC current transported by the conductors in the cores is parallel or nearly parallel to the armour wires. This cause the eddy currents induced into the armour wires to be perpendicular or nearly perpendicular with respect to the armour wires longitudinal axis.

In the light of the above observations, the Applicant found that it is possible to reduce the armour losses in an AC cable by using an armour winding pitch B unilay to the core stranding pitch A, with 0.4A≤B≤2.5A. In particular, the Applicant found that, by using an armour winding pitch B unilay to the core stranding pitch A, with 0.4A≤B≤2.5A, the ratio $\lambda_{2'}$ of losses in the armour to total losses in all conductors in the electric cable is much smaller than the value $\lambda_2$ as computed according to the above mentioned formula (2) of IEC Standard 60287-1-1.

In particular, and advantageously, $\lambda_{2'} \leq 0.75\lambda_2$. Preferably, $\lambda_{2'} \leq 0.50\lambda_2$. More preferably, $\lambda_{2'} \leq 0.25\lambda_2$. Even more preferably, $\lambda_{2'} \leq 0.10\lambda_2$.

Taking into account the above formula (1) provided by IEC 60287-1-1, the unilay configuration of armour wires and cores enables to increase the permissible current rating of a cable. The rise of permissible current rating leads to two improvements in an AC transport system: increasing the current transported by a cable and/or providing a cable with a reduced cross section area S, the increase/reduction being considered with respect to the case wherein the armour losses are instead computed according to formula (2) above mentioned.

This is very advantageous because it enables to make a cable more powerful and/or to reduce the size of the conductors with consequent reduction of cable size, weight and cost.

For example, in the case of the unilay cable of FIG. 3 (with A=1442 mm, B=1117 mm, S=500 $mm^2$), the Applicant computed the parameter $\lambda_2$ by using the above formula (2) provided by IEC 60287-1-1. By using the value of $\lambda_2$ so computed ($\lambda_2$=0.317), the Applicant calculated the permissible current rating by using the above formula (1) provided by IEC 60287-1-1 and, considering a laying depth of 1.5 m, an ambient temperature of 20° C., and soil thermal resistivity of 0.8 K·m/W, a permissible current rating value of 670 A was obtained.

On the other hand, the ratio $\lambda_{2'}$ of losses in the armour to total losses in all conductors of the same electric cable, experimentally measured by the Applicant by applying the Aron insertion (P. P. Civalleri, Lezioni di Elettrotecnica, Libreria editrice Levrotto & Bella, Torino 1981) resulted to be equal to about 0.025. That is, the ratio $\lambda_{2'}$ experimentally measured by the Applicant resulted to be more than ten time less than the $\lambda_2$ value computed according to the above mentioned formula (2) (that is $\lambda_{2'} \leq 0.10\lambda_2$).

The Applicant observes that by using the above formula (1) in the same laying condition as mentioned above, but with $\lambda_2$ reduced to 0.0317 (one tenth of 0.317), the permissible current rating becomes 740 A. This means that a current much higher than that calculated by considering $\lambda_2$ as computed according to IEC 60287 can be transported by a given cable having, according to the invention, armour winding pitch B unilay to the core stranding pitch A, with $0.4A \leq B \leq 2.5A$.

On the other side, in the same laying condition and with $\lambda_2$ reduced to 0.0317 (one tenth of 0.317) the same permissible current rating of 670 A can be achieved with a 400 $mm^2$ conductor in the place of a 500 $mm^2$ conductor (80% of cross section area S reduction). This means that a given current can be transported by a cable with a conductor size much lower than that required by IEC 60287, when such cable has, according to the invention, armour winding pitch B unilay to the core stranding pitch A, with $0.4A \leq B \leq 2.5$.

Figure 6:
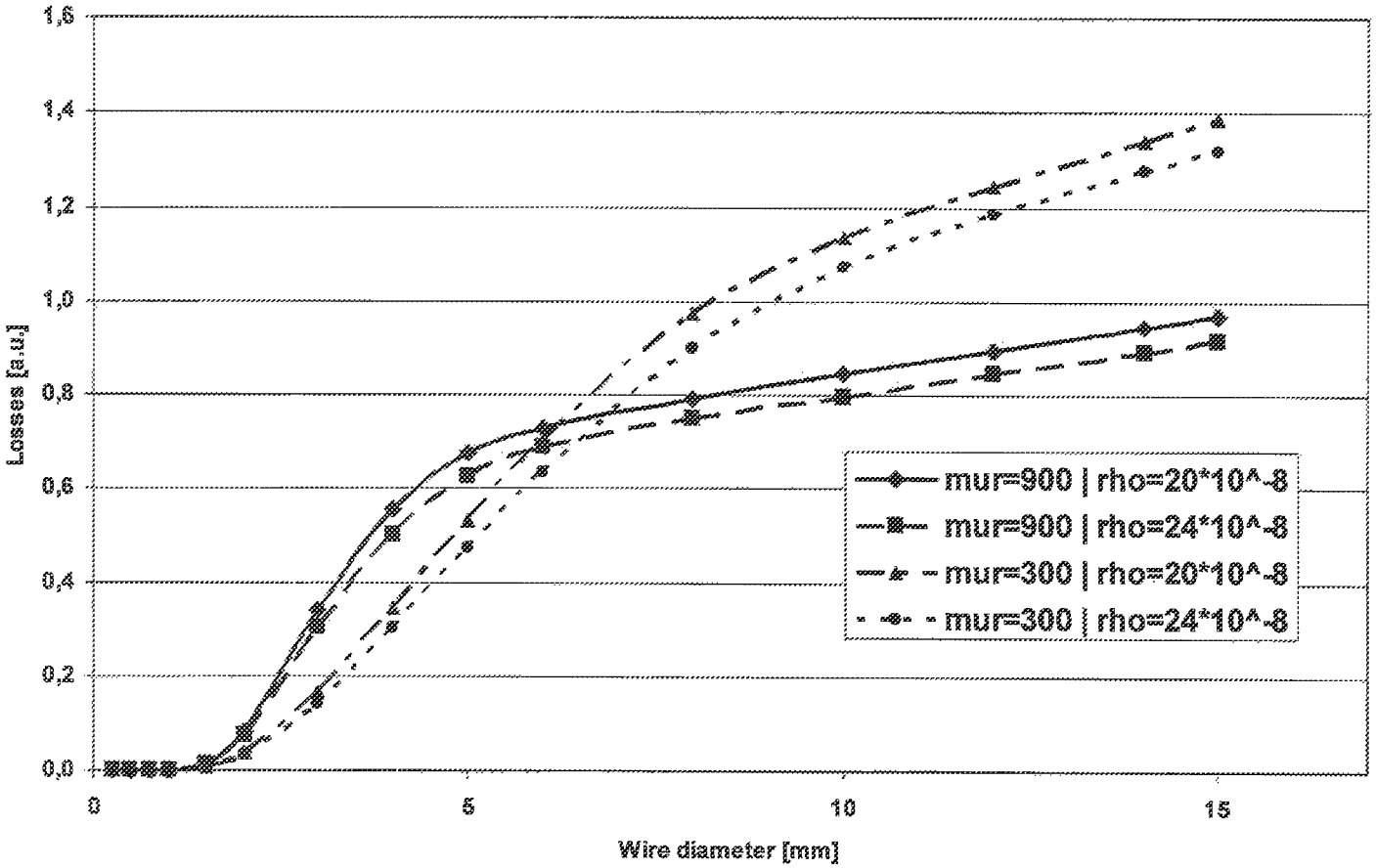
FIG. 6 reports the losses induced into a cylindrical wire of ferromagnetic material versus the wire diameter, with different values of electrical resistivity and relative magnetic permeability.

FIG. 6 reports FEM computation of losses (in arbitrary unit) induced into a cylindrical wire of ferromagnetic material versus the wire diameter, with different values of electrical resistivity and relative magnetic permeability. Two cases for electrical resistivity, respectively of 20·10-8 Ohm·m and of 24·10-8 Ohm·m, and two cases for relative magnetic permeability, respectively of mur=300 and mur=900 were considered. The combination of the previous cases leads to four representative cases, listed in FIG. 6.

The ranges indicated in FIG. 6 are typical for construction steel.

From FIG. 6, it is evident that, in order to reduce the losses, for wire diameters below 6 mm it is better to chose materials with lower relative magnetic permeability.

On the other hand, for wire diameters above 6 mm it is better to chose materials with higher relative magnetic permeability.

In addition, for any wire diameter, with an equal value of relative magnetic permeability, it is better to chose materials with higher electrical resistivity.

Considering that typical value of resistivity for armouring wires is of about $14 \cdot 10^{-8}$ Ohm·m, according to the invention the armour wire preferably have a resistivity at least equal to $14 \cdot 10^{-8}$ Ohm·m, more preferably at least equal to $20 \cdot 10^{-8}$ Ohm·m.

In addition, considering that typical value of relative magnetic permeability for armouring wires is of about 300, according to the invention the armour wire preferably have a relative magnetic permeability higher or smaller than 300 depending upon the fact that the wire diameter is above or below 6 mm.

It is further observed that according to the invention, in view of the results shown in FIG. 2, the number of ferromagnetic wires is preferably reduced with respect to a situation wherein that armour ferromagnetic wires cover all the external perimeter of the cable.

Number of wires in an armour layer can be, for example, computed as the number of wires that fill-in the perimeter of the cable and a void of about 5% of a wire diameter is left between to adjacent wires.

In order to reduce the number of ferromagnetic wires, the armour can advantageously comprise ferromagnetic wires alternating with non-ferromagnetic wires (e.g., plastic or stainless steel). In addition, or in alternative, the armour wires can comprise a ferromagnetic core surrounded by a non-ferromagnetic material.

It is noted that even if in the above description and figures cables comprising armour with a single layer of wires have been described, the invention also applies to cables wherein the armour comprises a plurality of layers, radially superimposed.

In such cables, the multiple-layer armour preferably comprises a (inner) layer of wires with an armour winding lay and an armour winding pitch B, a first outer layer of wires, surrounding the (inner) layer, with a first outer layer winding lay and a first outer layer winding pitch B' and, optionally, a second outer layer of wires, surrounding the first outer layer, with a second outer layer winding lay and a second outer layer winding pitch B".

As to the features of the (inner) layer, the armour winding lay, the armour winding pitch B, the core stranding lay and the core stranding pitch A, the same considerations made above with reference to an armour with a single layer of wires apply. In particular, the armour winding lay of the inner layer is unilay to the core stranding lay.

As to the first outer layer, the first outer layer winding lay is preferably contralay with respect to the core stranding lay (and to the armour winding lay). This advantageously improves the mechanical performances of the cable.

When also the second outer layer of wires is present, the second outer layer winding lay is preferably unilay to the core stranding lay (and to the armour winding lay).

As explained in detail above, when the armour winding lay of the (inner) layer of wires is unilay to the core stranding lay, the losses in the armour are highly reduced as well as the magnetic field (as generated by the AC current transported by the cable conductors) outside the (inner) layer of the armour, which is shielded by the inner layer. In this way, the first outer layer, surrounding the (inner) layer, experiences a reduced magnetic field and generates lower armour losses, even if used in a contralay configuration with respect to the core stranding lay.

For cables comprising multiple-layer armour, the same considerations made above with reference to the ratio $\lambda_{2'}$ (losses in the armour to total losses in all conductors in the electric cable) apply, wherein the losses in the armour are computed as the losses in the (inner) layer, the first outer layer and, when present, the second outer layer.

The invention claimed is:

1. A power cable for transporting an alternate current at a maximum allowable working conductor temperature comprising:

at least two cores stranded together according to a core stranding lay and a core stranding pitch A, each core comprising an electric conductor having a cross section area and conductor losses when the current is transported; and an armour surrounding the at least two cores, said armour comprising one layer of a plurality of metal wires wound around the cores according to a helical armour winding lay and an armour winding pitch B, said armour having armour losses when the current is transported, said conductor losses and armour losses contributing to overall cable losses determining the maximum allowable working conductor temperature, wherein:

the helical armour winding lay has a same direction as the core stranding lay, the cross section area S is such to cause the cable to operate at the maximum allowable working conductor temperature T while transporting the alternate current I with armour losses equal to or lower than 30% of the overall cable losses, and the armour winding pitch B and the core stranding pitch A are such that a crossing pitch C is higher or equal to 3A, the armour winding pitch B differing from the core stranding pitch A by at least 10%, and the crossing pitch C being defined by the following relationship:

$$C = \left| \frac{1}{\frac{1}{A} - \frac{1}{B}} \right|.$$

2. The power cable for transporting an alternate current according to claim 1, wherein C≥5A.

3. The power cable for transporting an alternate current according to claim 2, wherein C≥10A.

4. The power cable for transporting an alternate current according to claim 2, wherein C is not higher than 12A.

5. The power cable for transporting an alternate current according to claim 1, wherein the core stranding pitch A, in modulus, is from 1000 to 3000 mm.

6. The power cable for transporting an alternate current according to claim 5, wherein the core stranding pitch A, in modulus, is from 1500 mm.

7. The power cable for transporting an alternate current according to claim 5, wherein the core stranding pitch A, in modulus, is not higher than 2600 mm.

8. The power cable for transporting an alternate current according to claim 1, wherein the armour losses are equal to or lower than 10% of the overall cable losses.

9. The power cable for transporting an alternate current according to claim 1, wherein the armour losses are equal to or lower than 3% of the overall cable losses.

10. The power cable for transporting an alternate current according to claim 1, wherein the armour further comprises a first outer layer of a plurality of metal wires, surrounding said layer of a plurality of metal wires, the metal wires of said first outer layer being wound around the cores according to a first outer layer winding lay and a first outer layer winding pitch B'.

11. The power cable for transporting an alternate current according to claim 10, wherein the first outer layer winding lay has an opposite direction with respect to the core stranding lay.

12. The power cable for transporting an alternate current according to claim 10, wherein the cross section area of the electric conductor is such to cause the cable to operate at the maximum allowable conductor temperature while transporting the alternate current with armour losses equal to or lower than 30% of the overall cable losses, the armour losses comprising both the losses in said layer and in said first outer layer.

13. A method for improving the performances of a power cable comprising at least two cores stranded together according to a core stranding lay and a core stranding pitch A, each core comprising an electric conductor having a cross section area S and conductor losses when the alternate current I is transported; and an armour surrounding the at least two cores, said armour comprising one layer of a plurality of metal wires wound around the cores according to a helical armour winding lay and an armour winding pitch B, said armour having armour losses when the alternate current I is transported; said conductor losses and armour losses contributing to overall cable losses determining the maximum allowable working conductor temperature T, the method comprising:

reducing the armour losses to a value equal to or lower than 30% of the overall cable losses by building the power cable such that:

the helical armour winding lay has the same direction as the core stranding lay, the armour winding pitch B differs from the core stranding pitch A by at least 10%, and the armour winding pitch B and the core stranding pitch A are such that a crossing pitch C is higher or equal to 3A, the crossing pitch C being defined by the following relationships:

$$C = \left| \frac{1}{\frac{1}{A} - \frac{1}{B}} \right|;$$

and building the power cable with a reduced value of the cross section area S of the electric conductor, as determined by the value of the reduced armour losses.

14. A method for improving the performances of a power cable comprising at least two cores stranded together according to a core stranding lay and a core stranding pitch A, each core comprising an electric conductor having a cross section area S and conductor losses when the alternate current I is transported; and an armour surrounding the at least two cores, said armour comprising one layer of a plurality of metal wires wound around the cores according to a helical armour winding lay and an armour winding pitch B, said armour having armour losses when the alternate current I is transported; said conductor losses and armour losses contributing to overall cable losses determining the maximum allowable working conductor temperature T, the method comprising:

reducing the armour losses to a value equal to or lower than 30% of the overall cable losses by building the power cable such that:

the helical armour winding lay has the same direction as the core stranding lay, the armour winding pitch B differs from the core stranding pitch A by at least 10%, and the armour winding pitch B and the core stranding pitch A are such that a crossing pitch C is higher or equal to 3A, the crossing pitch C being defined by the following relationships:

$$C = \left| \frac{1}{\frac{1}{A} - \frac{1}{B}} \right|;$$

and operating the power cable at the maximum allowable working conductor temperature T by transporting said alternative current I with an increased value, as determined by the value of the reduced armour losses.

* * * * *